US005430941A

United States Patent [19]

Lin

[11] Patent Number: 5,430,941

[45] Date of Patent: Jul. 11, 1995

[54] PAIR OF SCISSORS WITH REPLACEABLE BLADES

[75] Inventor: Michael Lin, Her-Mei Town, Taiwan

[73] Assignee: Shung Wei Industrial Co., Ltd., Chang-Hua Hsien, Taiwan

[21] Appl. No.: 273,819

[22] Filed: Jul. 12, 1994

[51] Int. Cl.[6] ..... B26B 13/04

[52] U.S. Cl. ..... 30/260; 30/254

[58] Field of Search ..... 30/254, 260, 337, 338, 30/340, 342, 341, 236; 606/174; 403/322, 325, 327

[56] References Cited

U.S. PATENT DOCUMENTS 3,894,336 7/1975 Desimone ..... 30/260

5,086,563 2/1992 Sakuma et al. ..... 30/260

FOREIGN PATENT DOCUMENTS 2133730 8/1984 United Kingdom ..... 30/254

*Primary Examiner*—Hwei Siu Payer

*Attorney, Agent, or Firm*—Browdy and Neimark

[57] ABSTRACT

A pair of scissors with replaceable blades, comprising a pair of blades, a pair of grips each having a blade-connecting mechanism which permits the blades to be replaceably engaged with the grips includes a pair of locking members, a pair of controlling push blocks, a pair of cover members and a pair of springs. Each of the blades has a lower end portion grips formed with reverse hook-like teeth and each of the grips is formed with an engaging recess for receiving the lower end portion of the blade. A projecting block and a notch are respectively formed on upper and lower sections of inner side of the recess. A slide channel is formed beside the notch and a rib is formed on an outer and a lower sides of the recess. Three locking teeth are formed on an outer side of each locking member and a slant triangular cut is formed on an inner lower corner of the locking member. The controlling push block has a push board, a slant triangular projection extending inward from the push board and two rib sections disposed on two sides of the projection. A slide channel is formed on an inner lower section of the cover member and an insert hole and an arch depression are formed on a lower portion of the cover member.

1 Claim, 2 Drawing Sheets

PAIR OF SCISSORS WITH REPLACEABLE BLADES

BACKGROUND OF THE INVENTION

The present invention relates to a pair of scissors with replaceable blades, comprising a pair of blades, a pair of grips each having a blade-connecting mechanisman which replaceably connects with the blade. The blade-connecting mechanism includes a locking member, a controlling push block, a cover member and a spring. The lower end portion of the blade is adapted to be inserted into the engaging recess of the grip and removed therefrom by means of pushing the controlling push block.

The conventional scissors mostly have fixedly connected blades and grips which cannot be disassembled from each other for replacement. Therefore, once the blades are damaged, the whole scissors will have to be discarded. In addition, such scissors can be only applied on restricted situations and for other various requirements, several kinds of scissors with different sizes and profiles will be necessary. The cost for preparing these scissors is high and it is inconvenient to store and carry all these scissors.

Therefore, it is necessary to provide a pair of scissors with replaceable blades so that a damaged blade can be replaced by a new one and different kinds of blades can be interchangeably assembled with the grips to widely meet various requirements.

SUMMARY OF THE INVENTION

It is a primary object of the present invention to provide a pair of scissors with replaceable blades. Each grip of the scissors has a blade-connecting mechanism which permits different kinds of blades to be interchangeably assembled with the grip so as to widely meet various requirements.

It is a further object of the present invention to provide the above scissors, wherein a damaged blade can be replaced with a new one without discarding the whole scissors.

It is still a further object of the present invention to provide the above scissors, wherein various kinds of blades can be assembled with a common grip so that the room for storing the scissors can be reduced and the carriage of the scissors is facilitated.

It is still a further object of the present invention to provide the above scissors, wherein the blade is tightly and firmly assembled with the grip to achieve a reliable scissoring effect.

According to the above objects, the scissors of the present invention includes a pair of blades, a pair of grips each having a blade-connecting mechanism which permits the blade to be replaceably engaged with the grip. The blade-connecting mechanism includes a locking member, a controlling push block, a cover member and a spring. Each of the blades has a lower end portion formed with reverse hook-like teeth and each of the grips is formed with an engaging recess for receiving the lower end portion of the blade. A projecting block and a notch are respectively formed on upper and lower sections of inner side of the recess. A slide channel is formed beside the notch and a rib is formed on an outer and a lower sides of the recess. In addition, a pivot boss, a stopper and an arch depression are disposed on a lower portion of the recess. Three locking teeth are formed on an outer side of each locking member and a slant triangular cut is formed on an inner lower corner of the locking member. A pivot hole is formed on a lower half portion of the locking member. The controlling push block has a push board, a slant triangular projection extending inward from the push board and two rib sections disposed on two sides of the projection. A slide channel is formed on an inner lower section of the cover member and an insert hole and an arch depression are formed on a lower portion of the cover member. When assembled, the pivot boss of the engaging recess is first fitted into the pivot hole of the locking member and then the spring is disposed in the arch depression of the recess. The slant triangular projection of the controlling push block is locked in the slant triangular cut of the locking member and the rib sections of the projection are located in the slide channel of the recess. Then, the recess is covered by the cover member with the pivot boss inserted into the insert hole of the cover member. The adjoining portions of the recess and the cover member are sealed by ultrasonic wave to fixedly associate the grip and the cover member.

The present invention can be best understood through the following description and accompanying drawings, wherein:

DETAILED DESCRIPTION OF THE PREFERRED EMBODIMENT

Figure 1:
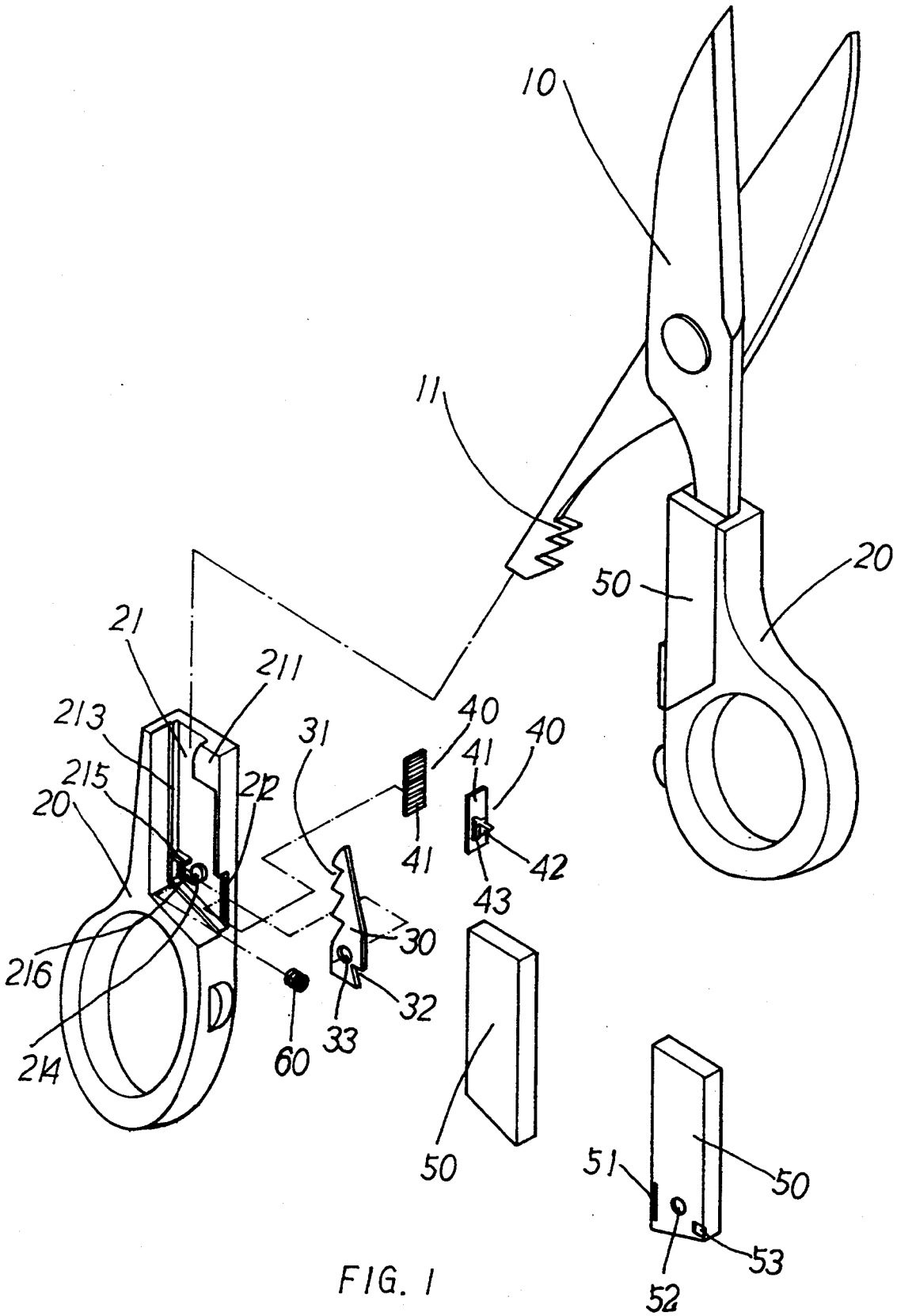
FIG. 1 is a perspective exploded view of the present invention.

Please refer to FIG. 1. The scissors of the present invention includes a pair of blades 10, a pair of grips 20 each having a blade-connecting mechanism which permits the blade 10 to be replaceably engaged with the grip 20. The blade-connecting mechanism includes a locking member 30, a controlling push block 40, a cover member 50 and a spring 60. Each of the blades 10 has a lower end portion and three reverse hook-like teeth 11 are formed on inner side of the lower end portion of the blade 10. Each of the grips 20 has an upper half portion formed with an engaging recess 21. A projecting block 211 is formed on an inner upper corner of the recess 21 and a notch is formed on an inner lower section of the recess 21. A slide channel 212 is formed beside the notch of the recess 21 and a rib 213 is formed on an outer and a lower sides of the recess 21. A pivot boss 214, a stopper 215 and an arch depression 216 are disposed on a lower half portion of the recess 21. Three locking teeth 31 are formed on an outer side of each locking member 30 and a slant triangular cut 32 is formed on an inner lower corner of the locking member 30. In addition, a pivot hole 33 is formed on a lower half portion of the locking member 30. The controlling push block 40 has a push board 41, a slant triangular projection 42 extending inward from the push board 41 and two rib sections 43 disposed on two sides of the projection 42. A slide channel 51 is formed on an inner lower section of the cover member 50. An insert hole 52 and an arch depression 53 are formed on a lower portion of the cover member 50.

Figure 2:
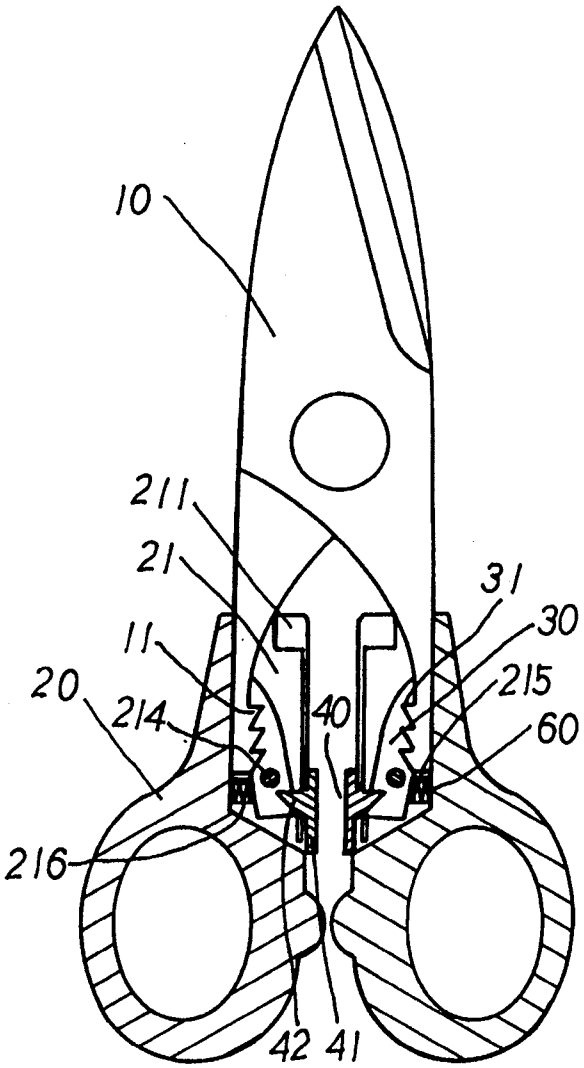
FIG. 2 is a sectional assembled view of the present invention.

Please refer to FIG. 2. When assembled, the pivot boss 214 of the engaging recess 21 is first fitted into the pivot hole 33 of the locking member 30 and then the spring 60 is disposed in the arch depression 216 of the recess 21 with one end of the spring 60 abutting against one side of the locking member 30. The slant triangular projection 42 of the controlling push block 40 is locked in the slant triangular cut 32 of the locking member 30 and the rib sections 43 of the projection 42 are located in the slide channel 212 of the recess 21. Then, the recess 21 is covered by the cover member 50 with the pivot boss 214 inserted into the insert hole 52 of the cover member 50, whereby the spring 60 is received in the arch depression 216 of the recess 21 and the arch depression 53 of the cover member 50. In addition, the rib sections 43 of the controlling push block 40 are located in the slide channel 212 of the recess 21 and the slide channel 51 of the cover member 50. The adjoining portions of the recess 21 and the cover member 50 are sealed by ultrasonic wave to fixedly associate the grip 20 and the cover member 50. When the lower end portion of the blade 10 is inserted into the engaging recess 21 of the grip 20, the spring 60 is resiliently biased and the three reverse hook-like teeth 11 of the blade 10 are locked by the three locking teeth 31 of the locking member 30. At this time, the lower end of the blade 10 abuts against the stopper 215 of the recess 21 to locate the blade 10 therein.

Figure 3:
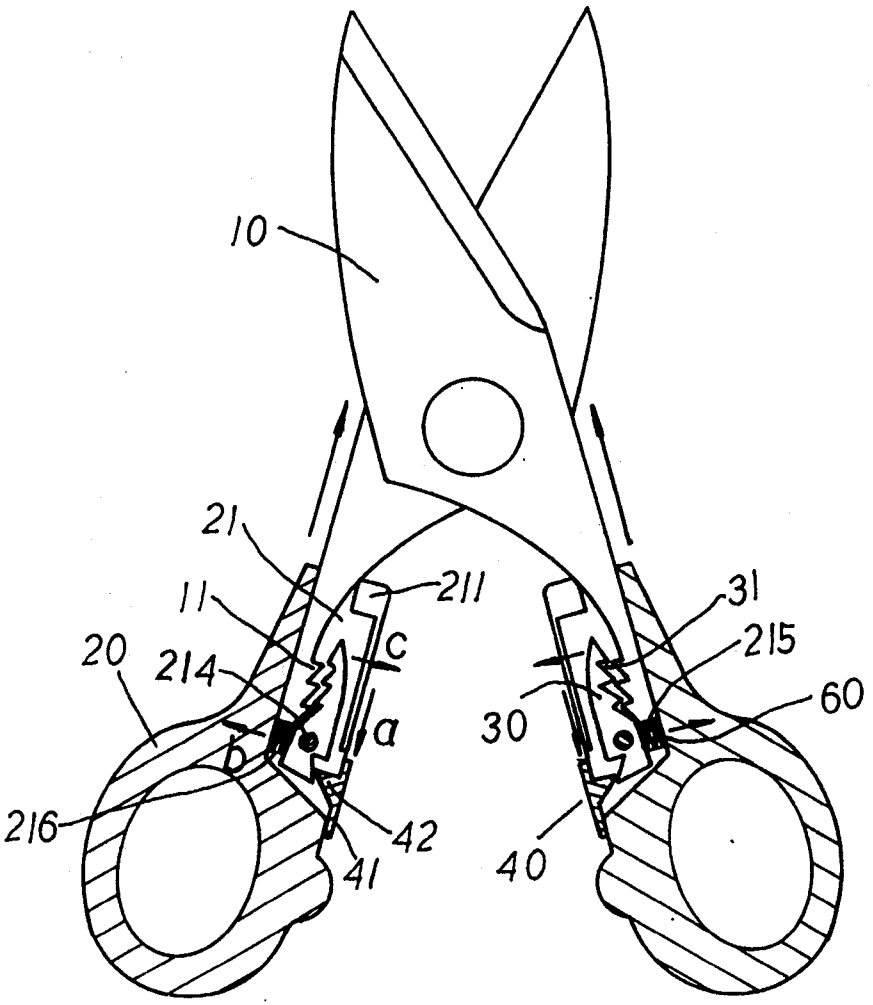
FIG. 3 shows the disassembling operation of the present invention.

Please refer to FIG. 3. When it is desired to remove or replace the blade 10, the push board 41 of the push block 40 is pushed downward in a direction shown by arrow a so as to drive the slant triangular projection 42 downward to bias the slant triangular cut 32 of the locking member 30 and outward deflect the lower portion of the locking member 30 in a direction shown by arrow b. At this time, the upper portion of the locking member 30 is reversely inward deflected in a direction shown by arrow c to compress the spring 60 and unlock the teeth 11 of the blade 10 from the the locking teeth 31 of the locking member 30. At this time, the blade 10 can be easily pulled upward away from the grip 20 in a direction shown by arrow d. Reversely, when assembling the blade 10 with the grip 20, the lower end portion of the blade 10 is inserted into the recess 21 of the grip 20. At this time, the lower end portion of the blade 10 biases the spring 60 and slides into the recess 21 along the outer side of the locking member 30 until the three teeth 11 of the blade 10 are locked by the locking teeth 31 of the locking member 30. Therefore, the blade 10 can be easily and quickly replaced with another type of blade.

The above preferred embodiment is only an example of the present invention and the scope of the present invention should not be limited to the example. Any modification or variation derived from the example should fall within the scope of the present invention.

What is claimed is:

1. A pair of scissors with replaceable blades, comprising a pair of blades, a pair of grips each having a blade-connecting mechanism which permits said blades to be replaceably engaged with said grips, said blade-connecting mechanism including a locking member, a controlling push block, a cover member and a spring, said scissors being characterized in that:

each of said blades has a lower end portion and reverse hook-like teeth formed on one side of said lower end portion of said blade;

each of said grips has an upper half portion formed with an engaging recess, a projecting block being formed on an inner upper corner of said recess and a notch being formed on an inner lower section of said recess, a slide channel being formed beside said notch and a rib being formed on an outer and a lower sides of said recess, a pivot boss, a stopper and an arch depression being disposed on a lower half portion of said recess;

locking teeth are formed on an outer side of each locking member and a slant triangular cut is formed on an inner lower corner of said locking member, a pivot hole being formed on a lower half portion of said locking member;

said controlling push block has a push board, a slant triangular projection extending inward from said push board and rib sections each disposed on a respective side of said projection; and a slide channel is formed on an inner lower section of said cover member and an insert hole and an arch depression are formed on a lower portion of said cover member, whereby said lower end portion of said blade is inserted into said recess of said grip to replaceably assemble said blade with said grip and said blade is removable from said grip by means of pushing said push board of said controlling push block and unlocking said reverse hook-like teeth of said blade from said locking teeth of said locking member, permitting said blade to be pulled away from said grip.

* * * * *